US005845673A

United States Patent [19]

Paul

[11] Patent Number: 5,845,673

[45] Date of Patent: Dec. 8, 1998

[54] MOUNTING APPARATUS FOR PIECES OF EQUIPMENT ESPECIALLY FLUID VALVES

[75] Inventor: Graham Donald Paul, Glasgow, Great Britain

[73] Assignee: The Horne Engineering Company Limited, Scotland, Great Britain

[21] Appl. No.: 800,122

[22] Filed: Feb. 13, 1997

[30] Foreign Application Priority Data

Feb. 14, 1996 [DE] Germany ..... 96030242

[51] Int. Cl.[6] ..... F16L 5/00

[52] U.S. Cl. ..... 137/360; 411/999; 411/347; 411/349

[58] Field of Search ..... 137/360; 411/999, 411/347, 349, 173; 52/126.4; 251/143

[56] References Cited

U.S. PATENT DOCUMENTS

| | | | |
|---|---|---|---|
| 1,835,301 | 12/1931 | Hennessey . | |
| 1,970,707 | 8/1934 | Riddell . | |
| 2,387,468 | 10/1945 | Ritzel | 411/347 |
| 2,649,884 | 8/1953 | Westover | 411/173 |
| 3,192,980 | 7/1965 | Sauter | 411/999 |
| 3,472,303 | 10/1969 | Beard | 411/999 |
| 3,516,629 | 6/1970 | Say | 411/999 |
| 3,718,950 | 3/1973 | Engstrom | 411/347 |
| 3,733,622 | 5/1973 | Searles . | |
| 4,572,232 | 2/1986 | Gruber | 137/360 |
| 4,723,881 | 2/1988 | Duran | 411/999 |
| 5,042,880 | 8/1991 | Garuti et al. | 411/999 |
| 5,046,521 | 9/1991 | Jensen . | |
| 5,148,976 | 9/1992 | Reid . | |
| 5,246,322 | 9/1993 | Salice | 411/349 |

*Primary Examiner*—Denise L. Ferensic
*Assistant Examiner*—John Ball
*Attorney, Agent, or Firm*—Thelen Reid & Priest LLP

[57] ABSTRACT

A special mounting apparatus is provided to support and locate a piece of equipment, especially a shower mixing valve in a wall cavity between a base wall and an outer facing, the mounting apparatus comprising a support member for securing to the base wall, a carrying plate serving to carry a piece of equipment e.g. fluid valve, and a jacking device for positioning the carrying plate relative to the base wall the device including a plurality of threaded studs attached to the support member and corresponding sleeve-form positioning nuts coupled to the carrying plate and threaded to the studs so as to form a telescopic assemblage therewith, compression springs being present between the nuts and the carrying plate. The mounting apparatus permits by selective adjustment of the nuts selective spacing of the carrying plate from the support member and also comprehensive tilting of the carrying plate relative to the support member to cater for angular irregularities at the base wall.

17 Claims, 6 Drawing Sheets

MOUNTING APPARATUS FOR PIECES OF EQUIPMENT ESPECIALLY FLUID VALVES

The present invention relates to a mounting apparatus for pieces of equipment, in particular fluid valves and more especially mixing valves for use for example in showers.

It is now common practice to fit the valve body of a shower mixing valve into a cavity between an outer surface, especially a tiled surface, and an inner (or base) wall, so that the valve body can be hidden from view along with the pipework connected to the body. There is thus provided a concealed arrangement with only the knobs controlling valve operation and an associated faceplate in view at the outer surface. Access to the valve body is via an aperture in the outer surface and the faceplate serves to cover this aperture.

The depth of the cavity between the outer surface and the inner wall can vary and a difficulty arises in ensuring that the faceplate is satisfactorily located on the outer surface. In prior art shower mixing valves which had their valve bodies substantially directly secured to the inner wall, this problem was solved by locating the valve control knobs on elongate stem portions carried by the valve body, and by having the faceplate slidable on these stem portions to enable the faceplate to engage the outer surface for a certain variation in the cavity depth. A further possible problem is that an angular discrepancy can exist between the outer surface and the inner wall and to meet this problem the aforesaid prior art valve required special skill on the part of the installer to make accurate tapering, packing pieces.

However, this prior art valve had certain disadvantages and in particular the elongate stem portions could detract from desired aesthetic standards especially where a minimal depth of the cavity was present so that the stem portions projected to a marked degree beyond the faceplate. Also the faceplate gasket was of a complex form. It is the principal object of the present invention to provide a mounting apparatus usable with a shower mixing valve to enable the above disadvantages to be overcome. A proposal which substantially avoids certain of the above disadvantages is described in U.S. Pat. No. 5,046,521. In particular U.S. Pat. No. 5,046,521 discloses a dedicated mounting assembly for mounting in-the-wall plumbing fittings such as mixing faucets, the assembly comprising an anchor plate which is fixed by screws to the inner wall while a plurality of threaded studs, in particular three are secured to the anchor plate so as to extend normally from the plate and serve to carry the fitting, to this end the studs being arranged in an array compatible with apertures in support flange means on the fitting. Thus for fitting support the studs extend through respective flange apertures and the fitting is located by a locating nut threaded on a respective stud and engaging an inner surface of the flange means, each locating nut having a sleeve portion extending through the aperture whereby, by having a tool receiving outer end, the locating nut can be adjusted from the outer side, while a lock nut threaded on the outer side of the stud engages the outer side of the flange means of for capturing of the flange means in a desired position on the studs.

To dampen sound transmission a U-cross section ring washer is located at each aperture and fills the annular space between the sleeve portion and the flange means, while the relevant lock nut engages a further annular member bearing on a surface of the U-ring. Thus the mounting assembly of U.S. Pat. No. 5,046,521 enables the fitting to be displaced fairly precisely relative to the inner wall but has the disadvantage of being relatively complex and again there is the disadvantage of being unable to accommodate satisfactorily out-of-parallel between the inner wall and the outer facing wall because the mounting does not permit effective tilting of the fitting relative to the anchor plate.

It is the principal object of the present invention to obviate or mitigate these disadvantages.

Therefore according to the present invention there is provided a mounting apparatus for a piece of equipment, especially but not exclusively a shower mixing valve, comprising carrying means for a piece of equipment, said carrying means including a support member adapted for securing to a support surface, e.g., a wall at a location point, a carrying member to hold a piece of equipment and a jacking device for the carrying member enabling the piece of equipment to be suitably positioned relative to said support surface; said jacking device comprising a plurality of jacking units whereby the carrying member can be displaced in a normal direction relative to said support member; each jacking unit comprising a threaded stud and a nut device threadingly received on the threaded stud, the carrying member being located on the nut device, each nut device including an abutment for the carrying member, the carrying member being adapted to tilt relative to the jacking units so as to form an acute angle $\alpha$ with said jacking units to cater for angular irregularities in the securing of said support member, and a compression spring means to bias the carrying member into engagement with said abutment on the nut device of each jacking unit, said compression spring being deformable to cater for tilting of the carrying member. In particular the jacking device can locate the valve body of a mixing valve appropriately in the wall cavity so allowing the valve body to mate with the faceplate and the knobs, the carrying member being secured to the inner wall of the cavity. In particular the present invention permits the knobs to be located at a set position relative to the faceplate, for varying cavity depths.

The compression spring permits variation in the angular setting of the piece of equipment e.g. valve body relative to said support wall: in particular these resilient means cater for angular discrepancy between the outer surface and the inner wall in the mounting of a mixing valve in the wall cavity.

An embodiment of the present invention will now be described by way of example with reference to the accompanying drawings wherein.

FIG. 7 again shows the portion A but catering for an out-of-parallel condition.

Figure 1:
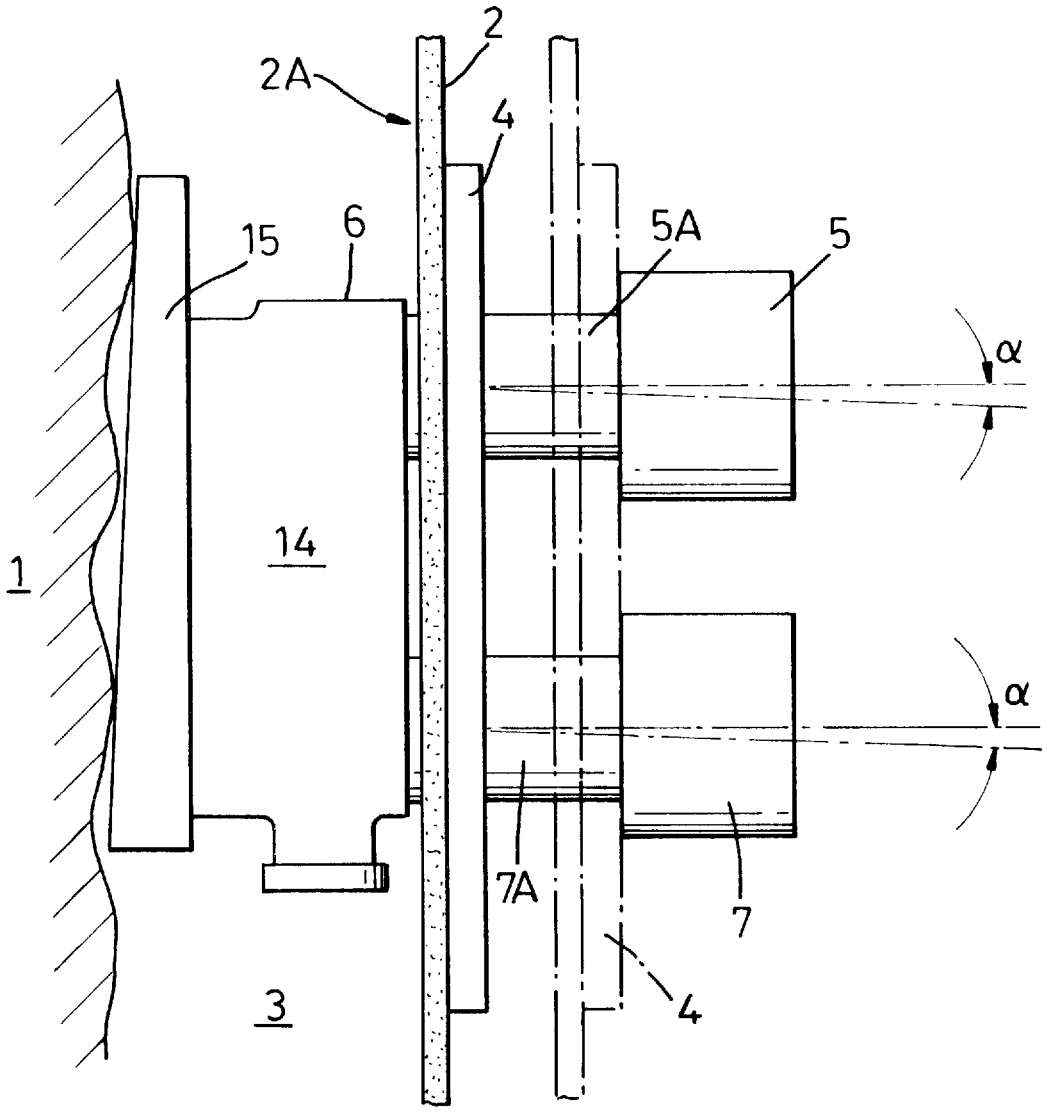
Fig. 1 (PRIOR ART)
FIG. 1 shows a schematic side view of a prior art shower mixing valve located in a wall cavity.

Referring firstly to the prior art arrangement in FIG. 1, a thermostatic i.e. shower mixing valve 6 has its valve body 14 located in a wall cavity 3 formed by an inner wall 1 which is usually a structural part of a building and an outer wall 2A for example comprising lightweight panelling which may be provided with a tiled outer surface 2, the pipework (not shown) connected to the valve 6 also being in the cavity so that the valve body 14 and the pipework are concealed. A knob 5 attached to the mixing valve 6 serves to adjust the temperature setting while a further knob 7 connected to the mixing valve 6 is used to turn the flow of mixed water on and off and so regulate the flow rate. A faceplate 4 is placed in contact with the tiled surface 2. The valve body 14 is substantially directly secured to the wall 1 although tapering packing 15 is invariably present to provide a certain positioning of the body. Nevertheless in this prior art valve to ensure that the faceplate 4 can be placed firmly against the tiled surface 2 for different cavity depths elongate stem portions 5A and 7A are present carrying the knobs 5, 7 with faceplate 4 slidable on these stem portions 5A, 7A. As can be seen for a minimal cavity depth as shown in FIG. 1 these stem portions 5A, 7A can extend markedly beyond the faceplate 4. Further the mounting surface provided by wall 1 may be locally out of parallel with wall 2 by a degree α.

Referring now to FIGS. 2 to 7 which show the present invention and illustrate an arrangement ensuring the knobs 5 and 7 of the mixing valve are fitted close to and within a dimensional tolerance of the faceplate 4. The mixing valve 6 shown in FIGS. 2 and 3 dispenses with the need for the stem portion 5A, 7A of the prior art valve. To this end a special mounting apparatus M is provided for the mixing valve 6 comprising an adjustable support plate 8 to carry the valve and a fixture plate 11.

The mixing valve 6 which advantageously can be in accordance with the valve described and claimed in U.S. Pat. No. 5,148,976 is attached to the adjustable plate 8 by fasteners 8A, while Plate 8 can be positionally adjusted relative to the fixed plate 11 by means of adjusting devices K.

Figure 4:
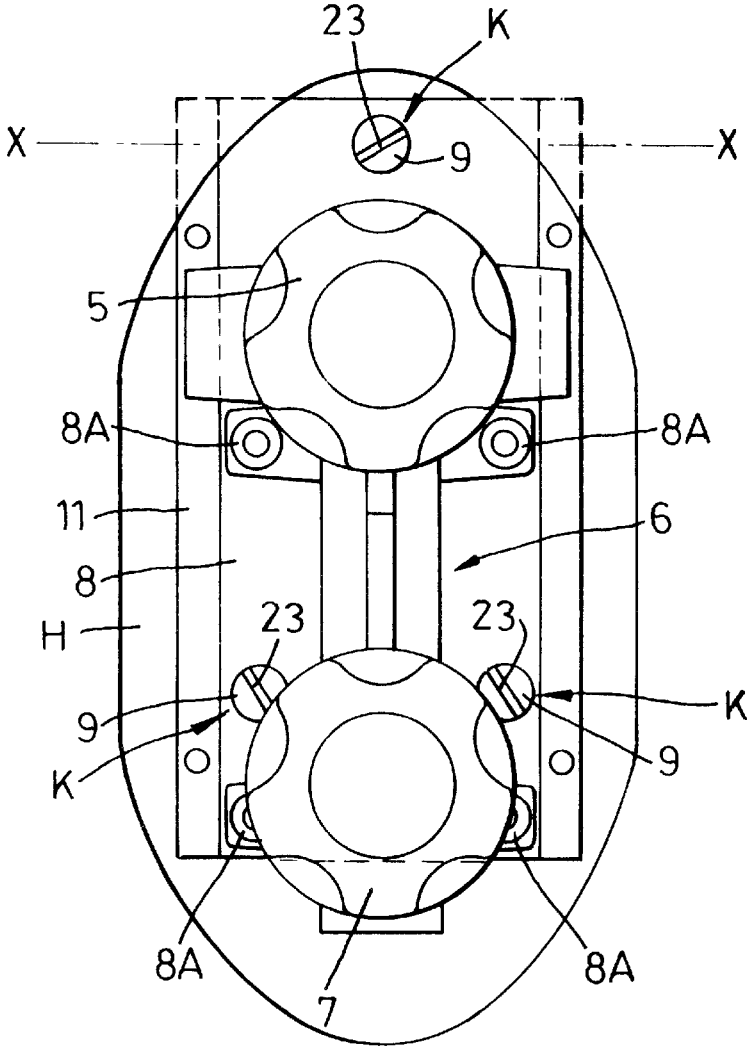
FIG. 4 is an end view in direction of arrow A in FIG. 2 with the faceplate ommitted.
Figure 5:
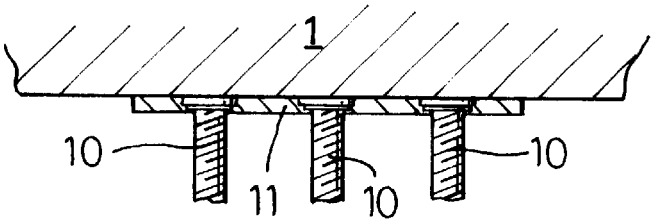
FIG. 5 shows section X—X on the mounting support plate in FIG. 4.
Figure 6:
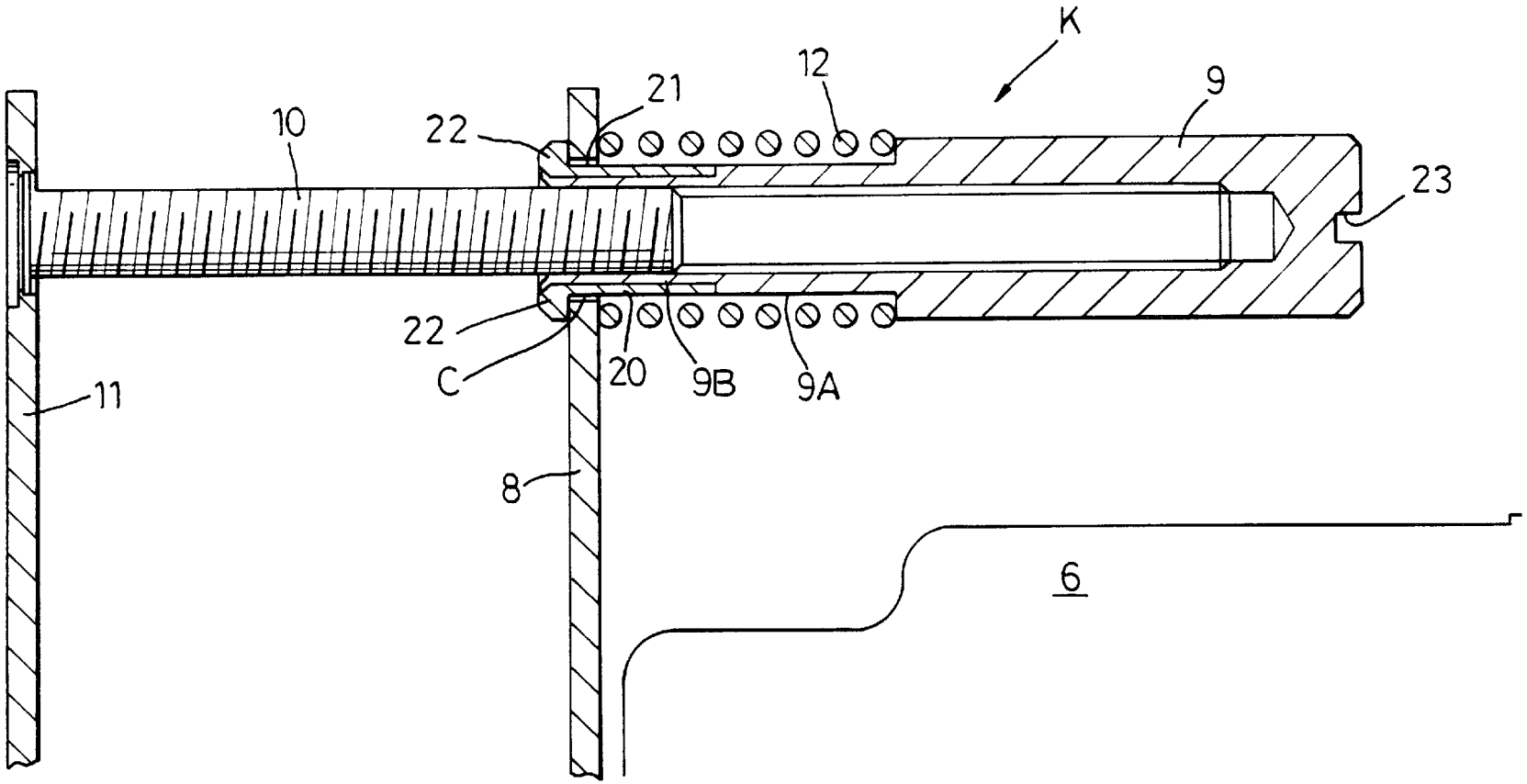
FIG. 6 shows the portion marked A of FIG. 3 in larger scale.
Figure 7:
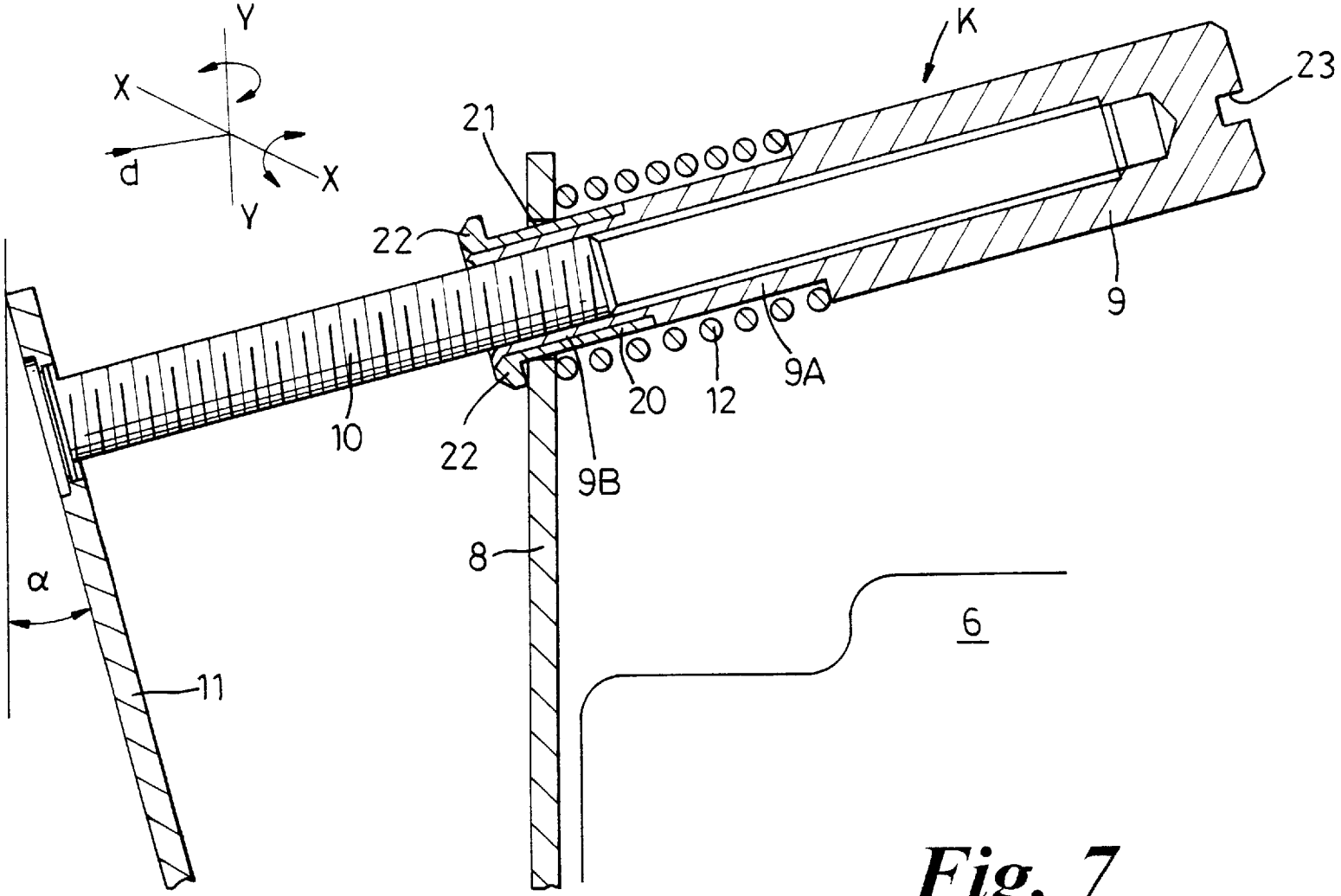

As can be seen in FIG. 4 three jacking or adjusting device K are present arranged in triangular array, and each device K comprises a stud 10 carried by the fixture plate 11 secured to base wall 1 and an adjusting nut 9 threaded onto the stud 10, the nut 9 being of sleeve form as can be seen from FIGS. 6 and 7. The stud 10 and nut 9 form a telescopical assemblage, the threaded bore of the nut 9 being blindwith a slot 23 on the nuts outer end to receive a screwdriver for nut adjustment. It is a feature of the arrangement that the nut 9 is permanently attached to the mounting plate 8, and to this end the nut 9 has a smaller diameter portion 9A onto a neck 9B of which a cap 20 is fitted through an aperture 21 on the plate 8, the cap 20 having an outer flange portion 22 engaging the inner face of the plate 8 while the outer end of the neck 9B is swaged onto the flange portion 22 to secure the nut 9 to the cap 20. Further, for the provision of angular float of the plate 8 the aperture 21 is sized to provide a clearance C with the nut 9.

An angularly flexible but linearly rigid support 12 comprising coil springs or other resilient means, e.g. rubber or polymer bushes, is located on the smaller diameter portion 9A (prior to fitting the cap 20) and so as to be slightly compressed whereby the plate 8 has a large degree of angular float with regard to the studs 10 and, as a result the mounting plate 8 can be adjusted to a substantial angle α relative to the fixture plate 11 (see FIG. 7). Consequently angular discrepancies between the fixture plate 11 mounting plane and surface 2 can be catered for.

In particular, the plate 8 can be simply displaced (d) from the wall which may be stone, brick or roughcast by uniformly adjusting all the nuts 9, or where the plate 11 is out of the vertical (FIG. 7) eg by angle α, due for example to irregularities in the wall by selective adjustment of the nuts 9 the plate 8 can be tilted about the X—X axis and/or about the Y—Y axis to a substantial degree if necessary. As can be seen in FIG. 7, the tilting action is expedited by the flexible (spring) support 12 ensuring that the nut 9 reacts uniformly against the plate 8 the support 12 compressing to one side to allow substantial tilting between the nut 9 and the plate 8, and it will also be noted very substantial angular irregularity can be catered for.

Figure 2:
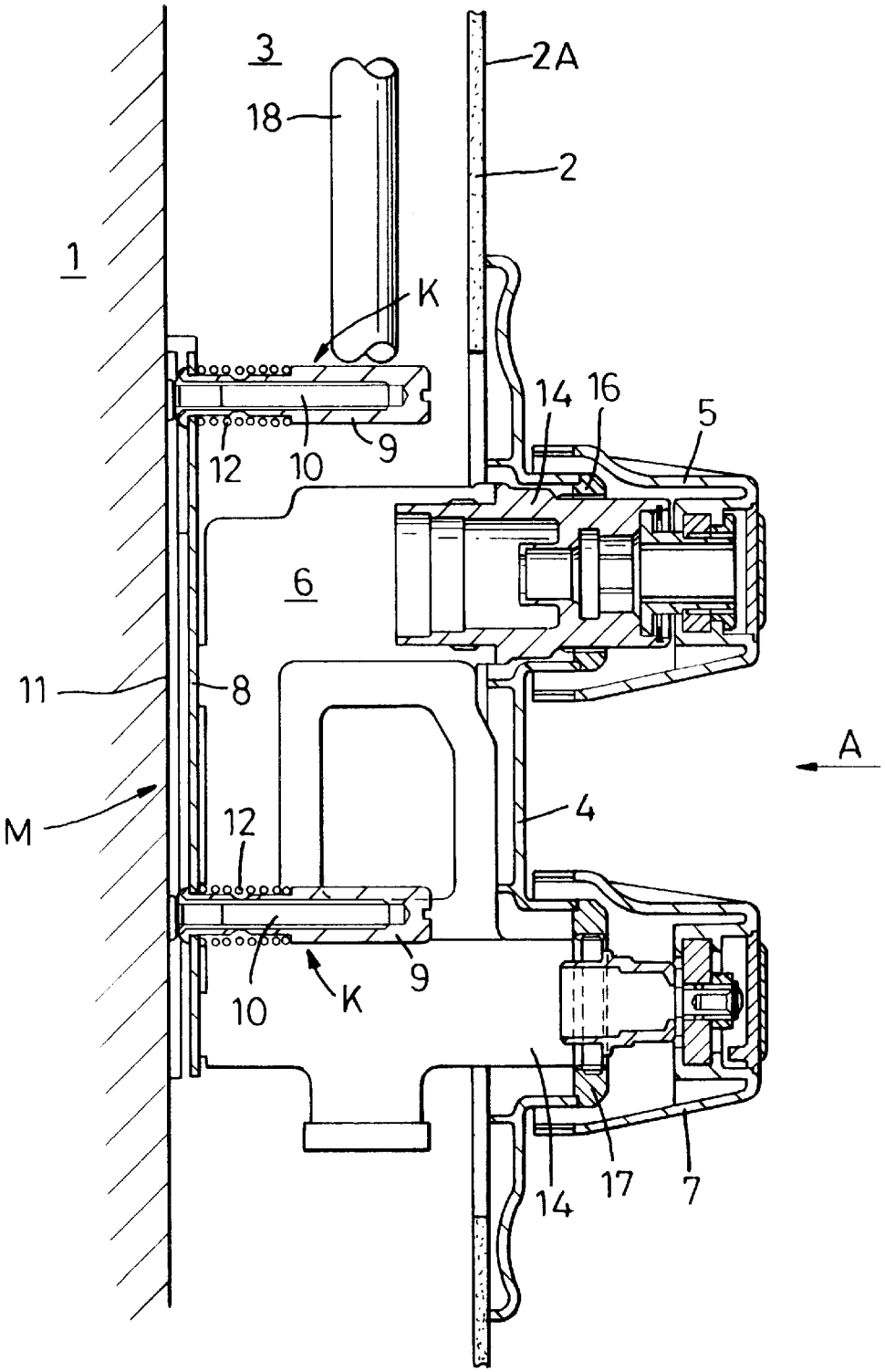
FIG. 2 shows a similar view for a shower mixing valve located by means of mounting apparatus in accordance with the present invention, where the cavity has a minimum depth.
Figure 3:
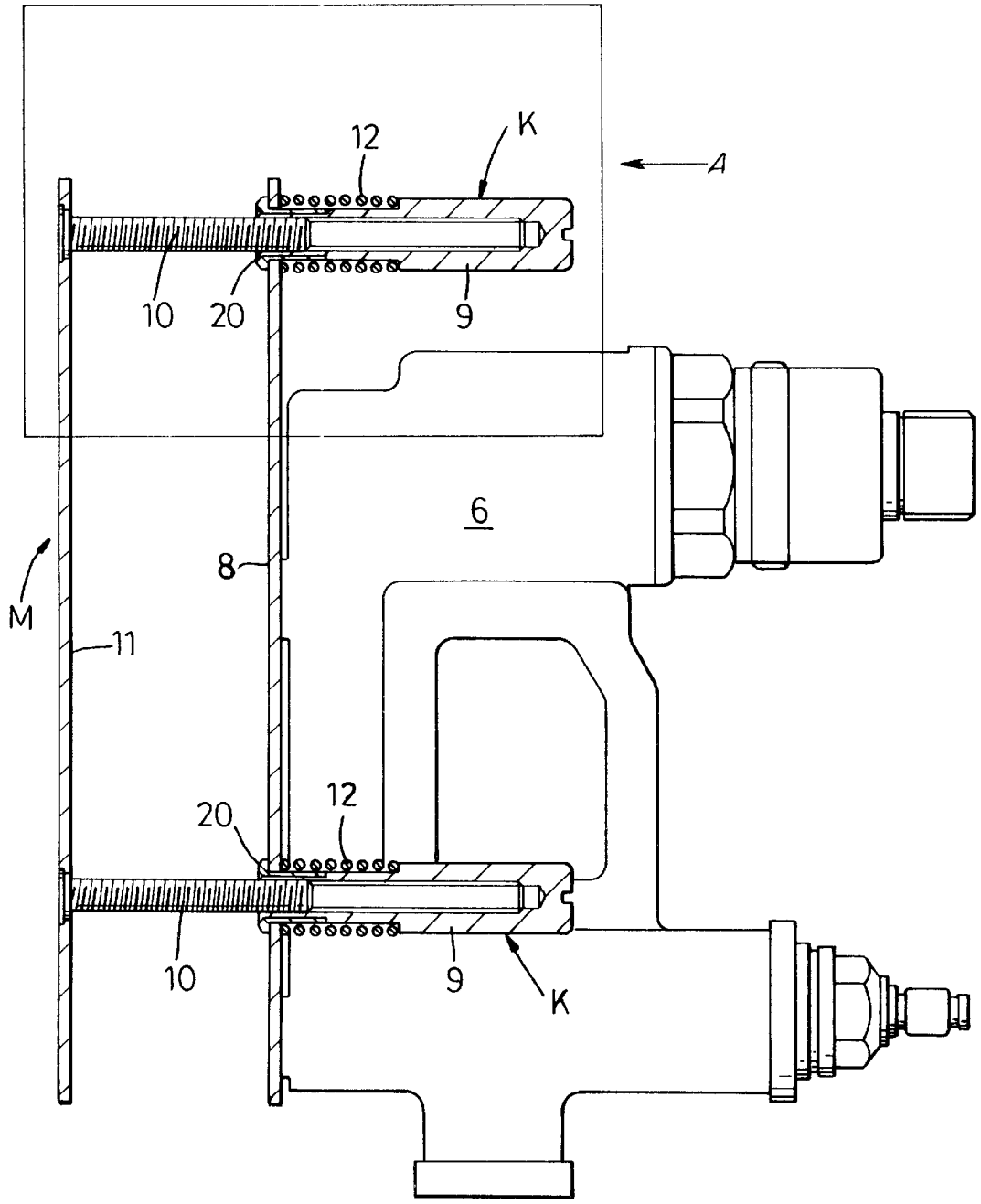
FIG. 3 shows a schematic view to FIG. 2 to a larger scale and with the mounting apparatus shown catering for a cavity of increased depth and the adjustment means shown in greater detail.

By turning the nuts 9, the mounting plate 8 can be adjusted to a desired distance from the fixed plate 11, for example within a range of 6 mm to 41 mm. The faceplate 4 is held against the surface 2, by means of nuts 16, 17 (FIG. 3) on the valve body 14, the nuts 16, 17 being concealed by the knobs 5, 7 positioned close to the faceplate 4. Access to the valve body 14 is via an aperture H (FIG. 4) in the outer wall 2A and the faceplate 4 serves to cover this aperture H. FIG. 2 shows part of the pipework 18.

The above arrangement in accordance with the present invention has the following advantages over previous methods of installing mixing valves.

1. The valve body 6 can be adjusted to suit the final position of the knobs 5 and 7 and faceplate 4.

To ensure a neat and pleasuring appearance, the knobs 5 and 7 and faceplate 4 can be designed conventionally as one unit. The distance from the faceplate 4 to the knobs 5 and 7 can be very short and within a dimensional tolerance, for varying cavity depths.

Prior art mixing valves (FIG. 1) are arranged such that the valve body is fixed to the inner wall with timber packing pieces and the faceplate is capable of sliding on the long cylindrical stems to compensate the variations in distance between the inner wall and the tiled surface. The arrangement however, means that there are long cylindrical pieces between the faceplate and the knobs and the exposed length of the cylindrical piece will vary depending upon the depth of cavity.

This means that the knobs and faceplate do not look as if they were designed as a single unit and the appearance is not pleasing.

2. The adjustable movement in the arrangement of the present invention is substantially more than the length of the cylindrical stems on the prior art valve and therefore, this arrangement can fit wide variations in depth of cavity.

3. It is not necessary to fit packing pieces 15 which must be made on site to compensate for the depth of cavity, and which require skill to be exercised to ensure that they site the valve on a plane parallel to the outer surface.

4. Adjustable plate 8 can be easily adjusted to a substantial angle between it and fixed plate 11. This means that the valve can be quickly and easily mounted in a true and plumb vertical plane.

5. The arrangement makes for ease of installation on site.

6. The telescopic nature of the adjustment allows adjustable plate 8 to be close to fixed plate 11 if desired and this results in a minimal depth 13 and allows the shower mixing valve to be installed in shallow cavity walls.

7. By virtue of the nuts 9 being permanently connected to the mounting plate 8, there is less liklihood of loss of items in the cavity 3, especially at initial installation as could happen for example with items, especially the lock nuts, in the mounting prior described U.S. Pat. No. 5,046,521. Whereas the above example was concerned with a shower mixing valve, the mounting apparatus M could be used with other fluid valves or indeed with other piece piece of equipment, which may require accurate positioning in terms of depth and/or angular plane of location in space.

I claim:

1. A mounting apparatus for a piece of equipment, especially but not exclusively a shower mixing valve, comprising carrying means for a piece of equipment, said carrying means including a support member configured for securing to a support surface, a carrying member to hold a piece of equipment and a jacking device for the carrying member constituting an adjustment means enabling the piece of equipment to be suitably positioned relative to said support surface; said jacking device comprising a plurality of jacking units whereby the carrying member can be displaced in a normal direction relative to said support member; each jacking unit comprising a threaded stud and a positioning nut device threadingly received on the threaded stud, the carrying member being located on each jacking unit, each nut device including an abutment for the carrying member, the carrying member being configured to tilt relative to the jacking units so as to form an acute angle with said jacking units to cater for angular irregularities in the securing of said support member, and resilient means in the form of a compression spring on each jacking unit to bias the carrying member into engagement with said abutment on the nut device of each jacking unit whereby the carrying member can be positioned relative to the support member by positioning of the nut devices on their respective studs, said compression spring being deformable to cater for tilting of the carrying member.

2. A mounting apparatus as claimed in claim 1, wherein said nut device is of elongate sleeve form and threaded to said stud so as to form a telescopic assemblage with said stud.

3. A mounting apparatus as claimed in claim 1, wherein the carrying member can tilt about two orthogonal axes, relative to said support member.

4. A mounting apparatus as claimed in claim 2, wherein said nut device has a recessed outer end to receive an adjusting tool.

5. A mounting apparatus as claimed in claim 1, wherein the nut device is permanently coupled to the carrying member.

6. A mounting apparatus as claimed in claim 2, wherein said compression spring surrounds a reduced diameter portion of said nut device.

7. A mounting apparatus as claimed in claim 2, wherein said carrying member is of plate form.

8. A mounting apparatus for a piece of equipment, especially but not exclusively a shower mixing valve, comprising carrying means for a piece of equipment, said carrying means including a support member configured for securing to a support surface, a carrying member to hold a piece of equipment and a jacking device for the carrying member constituting an adjustment means enabling the piece of equipment to be suitably positioned relative to said support surface; said jacking device comprising a plurality of jacking units whereby the carrying member can be displaced in a normal direction relative to said support member each jacking unit comprising a threaded stud with a positioning nut device threadingly secured thereon and serving for support of the carrying member, each nut device including an abutment for the carrying member, the carrying member being configured for tilting on the nut devices of the jacking units so as to form an acute angle with said jacking units to cater for angular irregularities in the securing of said support member, and resilient means in the form of a compression spring located on each nut device between a larger diameter head part of the nut device and said carrying member so that said compression spring biases the carrying member into engagement with the abutment of the nut device whereby the carrying member can be positioned relative to the support member by positioning of the nut devices on their respective studs, said compression spring being deformable to cater for tilting of the carrying member on the jacking units.

9. A mounting apparatus as claimed in claim 8, wherein said nut device is of elongate sleeve form coupled to said carrying member and threaded to said stud so as to form a telescopic assemblage with said stud.

10. A mounting apparatus as claimed in claim 8, wherein the carrying member can tilt about two orthogonal axes, relative to said support member.

11. A mounting apparatus as claimed in claim 9, wherein said nut device has a recessed outer end to receive an adjusting tool.

12. A mounting apparatus as claimed in claim 8, wherein the nut device is permanently coupled to the carrying member.

13. A mounting apparatus as claimed in claim 12, wherein said nut device is permanently coupled to the carrying member by means of a cap constituting said abutment fitted to the nut device and engaging an inner face of the carrying member, while the compression spring engages the outer face of the carrying member.

14. A mounting apparatus as claimed in claim 9, wherein said compression spring surrounds a reduced diameter portion of said nut device.

15. A mounting apparatus as claimed in claim 8, wherein said carrying member is of plate form.

16. A mounting apparatus as claimed in claim 8, wherein the support member comprises a flat plate.

17. A mounting assembly for mounting a fluid valve having a valve body with a valve stem projecting therefrom including a control element for controlling a valve setting, said assembly comprising a mounting apparatus for mounting said fluid valve in a desired position between a vertical base wall constituting a support surface and an apertured cover wall spaced from said base wall such that the valve stem projects through said aperture of the cover wall, said mounting apparatus comprising carrying means for the fluid valve, said carrying means including a support member configured for securing to said base wall at a location point, a carrying member to hold said fluid valve and a jacking device for the carrying member constituting an adjustment means enabling the fluid valve to be suitably positioned relative to said base wall; said jacking device comprising a plurality of jacking units whereby the carrying member can be displaced in a normal direction relative to said support member; each jacking unit comprising a threaded stud and a positioning nut device threadingly received on the threaded stud, the carrying member being located on the nut device, each nut device including an abutment for the carrying member, the carrying member being configured to tilt relative to the jacking units so as to form an acute angle with said jacking units to cater for angular irregularities in the securing of said support member, and resilient means in the form of a compression spring located between a larger diameter head part of the nut device and the carrying member to bias the carrying member into engagement with said abutment on the nut device of each jacking unit, said compression spring being deformable to cater for tilting of the carrying member, said assembly further including a cover plate for said aperture configured to be held against the cover wall by a nut on said valve stem.

* * * * *